US006059025A

United States Patent [19]

Hossfeld

[11] Patent Number: 6,059,025

[45] Date of Patent: May 9, 2000

[54] HEAT EXCHANGER CONFIGURATION

[75] Inventor: Lawrence M. Hossfeld, Minnetonka, Minn.

[73] Assignee: Monsanto Enviro-Chem Systems, Inc., St. Louis, Mo.

[21] Appl. No.: 09/035,374

[22] Filed: Mar. 5, 1998

Related U.S. Application Data

[60] Provisional application No. 60/039,951, Mar. 6, 1997.

[51] Int. Cl.[7] ..... F28F 3/06

[52] U.S. Cl. ..... 165/166; 165/76; 165/81; 165/82

[58] Field of Search ..... 165/166, 82, 81, 165/76

[56] References Cited

U.S. PATENT DOCUMENTS

| | | | |
|---|---|---|---|
| 3,893,509 | 7/1975 | Satchwell et al. | 165/166 |
| 4,442,886 | 4/1984 | Dinulescu . | |
| 4,596,285 | 6/1986 | Dinulescu | 165/166 X |
| 4,616,695 | 10/1986 | Takahashi et al. | 165/166 X |
| 4,681,155 | 7/1987 | Kredo | 165/166 X |
| 4,848,450 | 7/1989 | Lapkowsky | 165/166 |
| 4,966,231 | 10/1990 | Belcher et al. | 165/166 |
| 5,033,537 | 7/1991 | Atkin et al. | 165/166 X |
| 5,072,790 | 12/1991 | Lapowsky | 165/166 |

FOREIGN PATENT DOCUMENTS

| | | | |
|---|---|---|---|
| 580039 | 7/1925 | France | 165/166 |
| 0020997 | 2/1981 | Japan | 165/166 |
| 0071795 | 6/1981 | Japan | 165/166 |
| 0202096 | 9/1986 | Japan | 165/166 |
| 0205795 | 9/1986 | Japan | 165/166 |
| 2063450 | 6/1981 | United Kingdom | 165/166 |

*Primary Examiner*—Christopher Atkinson

*Attorney, Agent, or Firm*—Senniger, Powers, Leavitt & Roedel

[57] ABSTRACT

A plate-type heat exchanger configuration which facilitates fluid flow along a generally "L" or "S" shaped path and which includes a plurality of heat exchanger plates with at least one of the edges comprised of a pair of edge sections which terminate in different edge configurations. The invention also relates to a plate configuration for such a heat exchanger.

17 Claims, 8 Drawing Sheets

FIG. 11
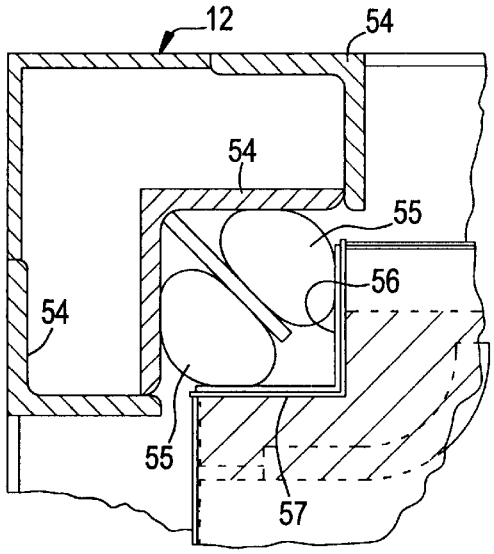
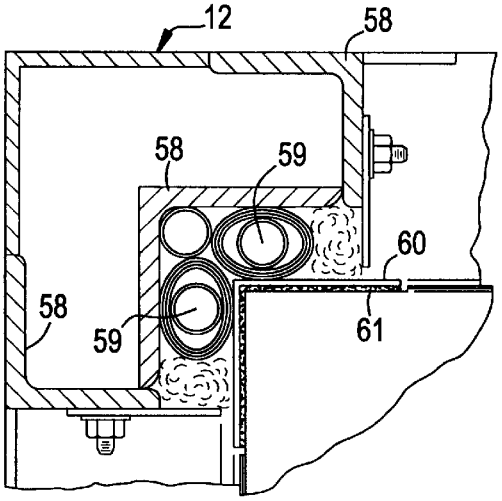
FIG. 12
FIG. 13
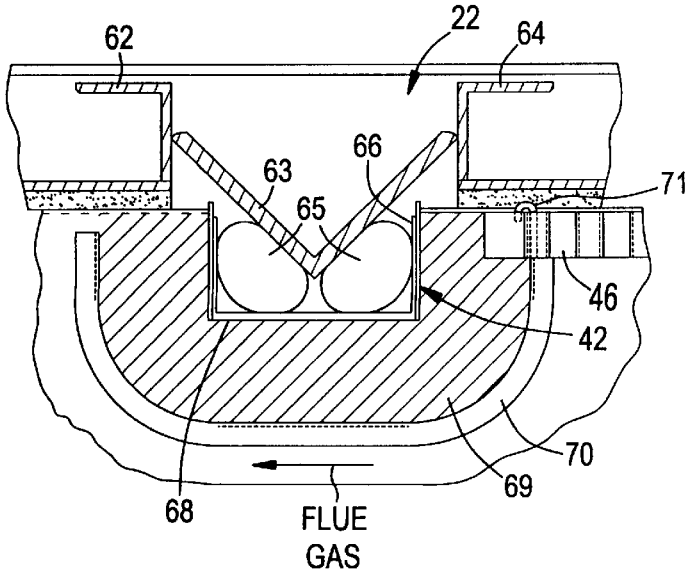

HEAT EXCHANGER CONFIGURATION

This application claims the benefit of Provisional Application Serial No. 60/039,951 filed Mar. 6, 1997.

BACKGROUND OF THE INVENTION

1. Field of the Invention

The present invention relates generally to a plate type, non-welded heat exchanger configuration and more particularly to a plate type, non-welded heat exchanger configuration which facilitates fluid flow through the heat exchanger along a generally "L" shaped path from one face to a face disposed at right angles thereto or facilitates the entry or exit of both fluids on the same face or on opposing parallel faces. The invention also relates to a heat exchanger plate configuration for use in the above heat exchanger.

2. Description of the Prior Art

Various types of heat exchangers currently exist for transferring heat from one fluid stream to another. Although it is contemplated that the concepts employed in the present invention may be useful in heat exchangers in which at least one of the fluids is a liquid, the primary application of the present invention and the application which is described in the preferred embodiment is an application where both of the fluids are gasses. A common type of heat exchanger is a plate type, non-welded heat exchanger of the type disclosed in U.S. Pat. No. 4,442,886 issued to Dinulescu. The entire disclosure of this U.S. Pat. No. 4,442,886 is incorporated herein by reference.

In general, a plate type, non-welded heat exchanger comprises a plurality or stack of parallel heat exchanger plates. These plates are spaced from one another to define alternate flow channels for two fluids of different temperatures. The plate type heat exchanger as disclosed in U.S. Pat. No. 4,442,886 embodies a generally rectangular configuration referred to as a plate block. The block comprises a stack of generally rectangular plates which are assembled and maintained in parallel relationship relative to one another by a rigid frame assembly. The frame assembly includes corner posts positioned at the corners of the rectangular plates and at right angles to each plate. A pair of connecting end walls join the corner posts and are disposed in parallel relationship relative to the plates. The heat exchanger block configuration of U.S. Pat. No. 4,442,886 defines a pair of opposing first inlet/outlet faces which are parallel to one another and perpendicular to the plates and a pair of opposing second inlet/outlet faces which are parallel to one another, perpendicular to the plates and perpendicular to the pair of opposing first inlet/outlet faces.

The plate blocks of U.S. Pat. No. 4,442,886 can be used separately or can be combined with other blocks to form various configurations of heat exchanger assemblies. The possible configurations can be further increased through the use of additional ductwork and/or a flow manifolds. The possible configurations that can be formed with the blocks of U.S. Pat. No. 4,442,886, however, are limited. For example, in the block of the '886 patent, one of the fluids can enter one of the faces and exit from the same face or from an opposing parallel face, but cannot enter a face and exit from a face which is perpendicular to the entering face. Further, in the block of the '886 patent, the two fluids must enter on different faces. This necessarily limits the configurations which are possible.

Accordingly, there is a need in the art for a heat exchanger unit or block which is capable of overcoming this deficiency, thereby significantly increasing the configurations of heat exchanger assemblies that can be formed.

SUMMARY OF THE INVENTION

In contrast to the prior art, the present invention relates to a plate type, non-welded heat exchanger unit in which both fluids can enter or exit on the same face or an opposing parallel face or the same fluid can enter through one face and exit from a second face at right angles to the entering face. The invention also relates to a heat exchanger plate configuration for use in the above heat exchanger. The ability of the heat exchanger of the present invention to function as described above significantly increases the possible heat exchanger assembly configurations which can be formed.

More specifically, the heat exchanger of the present invention includes a plurality or stack of generally rectangular heat exchanger plates. These plates are positioned in parallel relationship relative to one another and are maintained as a unit in such relationship by a rigid frame assembly. The frame assembly includes a plurality of corner posts positioned at the corners of the plates and at right angles to each plate. The frame assembly further includes a pair of end plates or end frame members which inter-connect the corner posts and which extend generally parallel to the plates.

The stack of plates forming the heat exchanger unit or block includes a pair of opposing first inlet/outlet faces which are parallel to one another and perpendicular to the plates and a pair of opposing second inlet/outlet faces which are parallel to one another, perpendicular to the plates and also perpendicular to the pair of first inlet/outlet faces.

Each plate includes a generally rectangular configuration having a pair of opposing first edges which are parallel to one another and a pair of opposing second edges which are parallel to one another and perpendicular to the pair of first opposing edges. The pair of opposing first edges and the pair of opposing second edges intersect with one another to define corners of the plate.

Each of the first and second opposing edges includes either a first edge configuration in the form an offset edge or of a second edge configuration in the form of an offset receiving edge, with at least one of the first and second opposing edges having both an offset edge section and an offset receiving edge section. In the embodiment of the present invention, an offset edge or an offset edge section is designed to receive a spring assembly and define a face or a face section through which one of the fluids can enter or exit the heat exchanger unit. Preferably at least two of the first and second opposing edges will have both an offset edge section and an offset receiving edge section.

Each of the first and second opposing edges which includes both an offset edge section and an offset receiving edge section further includes a transition area between the offset edge section and the offset receiving edge section and a mid-post assembly positioned in the transition area. The mid-post assembly includes a mid-post extending parallel to the corner posts and perpendicular to the plates which interfaces with the plates to seal the flow passages in adjacent plates from one another. Each plate is further provided with a plurality of flow channel ribs for directing the flow of its respective fluid from the inlet face or face section to the outlet face or face section.

Accordingly, it is an object of the present invention to provide a plate type, non-welded heat exchanger which significantly increases the possible heat exchanger assembly configurations.

Another object of the present invention is to provide a plate type, non-welded heat exchanger in which both fluids can enter or exit along the same inlet/outlet face or along opposing, parallel inlet/outlet faces.

Another object of the present invention is to provide a plate type, non-welded heat exchanger in which the same fluid can enter through a first inlet/outlet face and exit through a second inlet/outlet face which is at right angles relative to the entry face.

A further object of the present invention is to provide a heat exchanger assembly embodying a plurality of heat exchanger units in which at least one such unit is of the type described above.

A still further object of the present invention is to provide a heat exchanger plate having a configuration for use in the above heat exchanger unit.

These and other objects of the present invention will become apparent with reference to the attached drawings and to the description of the preferred embodiment.

DESCRIPTION OF THE DRAWINGS

FIG. 11 is a top elevational view, partially in section and with portions removed, showing one embodiment of a corner post assembly.

FIG. 12 is a top elevational view, partially in section and with portions removed, showing an alternate embodiment of a corner post assembly.

FIG. 13 is a top elevational view, partially in section and with portions removed, showing the mid-post assembly.

DESCRIPTION OF THE PREFERRED EMBODIMENT

The present invention relates generally to a plate type, non-welded heat exchanger comprising a plurality of parallel plates. Heat exchangers of this type are designed for transferring heat from a first fluid to a second fluid. Usually, these fluids are gasses. A common application for heat exchangers of this type is to transfer heat from flue gas to ambient air for the purpose of preheating the air for subsequent use. Accordingly, throughout the description of the preferred embodiment, the fluid streams shall be referred to as first and second fluid streams or simply as "flue gas" or "air".

Figure 1:
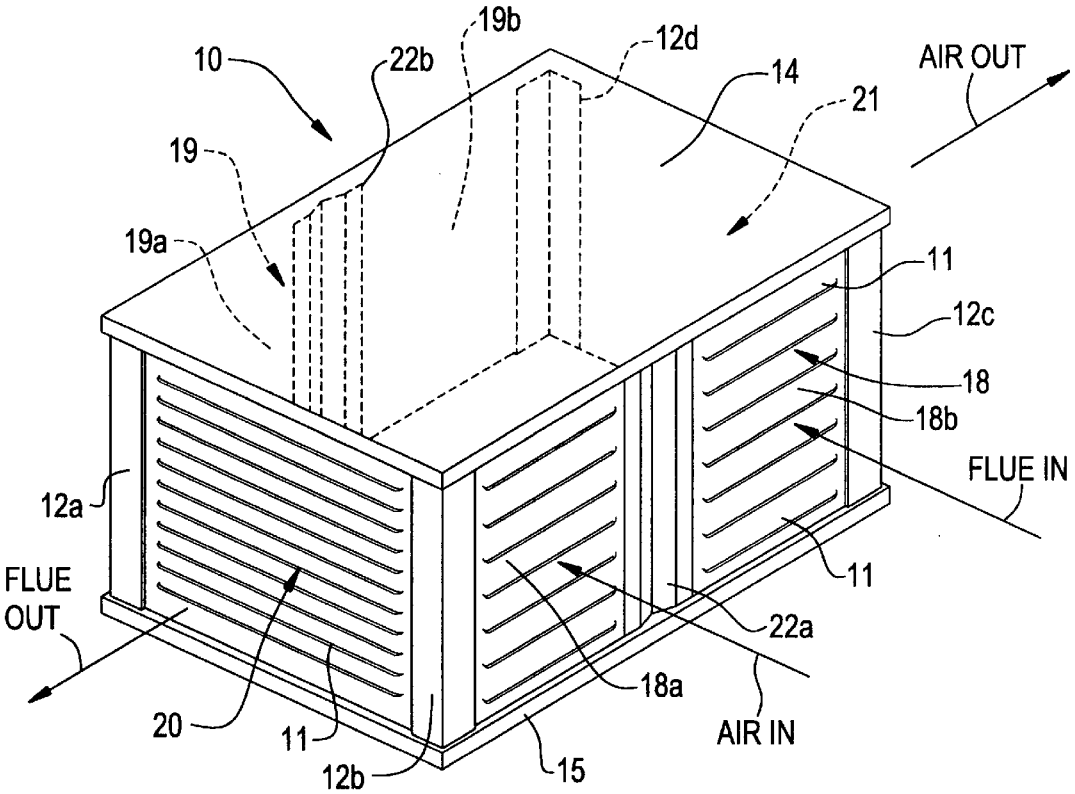
FIG. 1 is an isometric view of a single heat exchanger block or unit in accordance with the present invention with portions shown in broken lines.

With reference first to FIG. 1, the heat exchanger 10 of the present invention, sometimes also referred to herein as a heat exchanger unit or heat exchanger block, includes a plurality of generally rectangular plates 11. These plates are generally parallel to one another and extend throughout the entire rectangular configuration of the unit 10. The spaced plates 11 define alternate flow channels for flue gas and for air.

The plurality or stack of heat exchanger plates 11 is assembled and maintained in a unit as shown by a rigid frame assembly comprising a plurality of corner posts 12(*a*–*d*) and a pair of end plates 14 and 15. In the preferred embodiment, one of the corner posts 12(*a*–*d*) is positioned at each corner of each of the rectangular plates 11. Each of the corner posts 12(*a*–*d*) extends parallel to one another and perpendicular to each of the plates 11. The corner posts 12(*a*–*d*) are connected with and retained by the end plates 14 and 15. The end plates 14 and 15, as shown, are generally parallel to the plates 11. Although the end plates 14 and 15 in the preferred embodiment are shown as being solid rectangular plates, they can, if desired, comprise frame members or other similar supporting structure.

When assembled as shown in FIG. 1, the heat exchanger block or unit 10 defines a pair of opposing first inlet/outlet faces 18 and 19 which are parallel to one another and are perpendicular to the plates 11. The inlet/outlet face 18 extends between the corner posts 12*b* and 12*c* and includes face sections 18*a* and 18*b*. The inlet/outlet face 19 extends between the corner posts 12*a* and 12*d* and includes face sections 19*a* and 19*b*. The unit 10 also includes a pair of opposing second inlet/outlet faces 20 and 21. These faces 20 and 21 are parallel to one another, are perpendicular to the plates 11 and are perpendicular to the pair of opposing first inlet/outlet faces 18 and 19. The inlet/outlet face 20 extends between the corner posts 12*a* and 12*b*, while the inlet/outlet face 21 extends between the corner posts 12*c* and 12*d*.

Positioned between the corner post 12*b* and 12*c* in the embodiment of FIG. 1 is a mid-post assembly 22*a* which separates face section 18*a* from face section 18*b*. A similar mid-post assembly 22*b* is positioned between the corner posts 12*a* and 12*d* to separate face section 19*a* from face section 19*b*. These mid-post assemblies 22*a* and 22*b* are positioned in a transition area between heat exchanger plate sections and function to stabilize the plates 11 and to seal alternating flow chambers within the plates from one another.

In the embodiment of FIG. 1, flue gas enters the unit 10 through the inlet/outlet face section 18*b* between the mid-post 22*a* and the corner post 12*c* and exits through the inlet/outlet face 20 which is perpendicular to the face section 18*b*. The air enters the unit 10 through the inlet/outlet face section 18*a* between the corner post 12*b* and the mid-post 22*a* and exits through the inlet/outlet face 21 which is perpendicular to the face section 18*a*.

Figure 2:
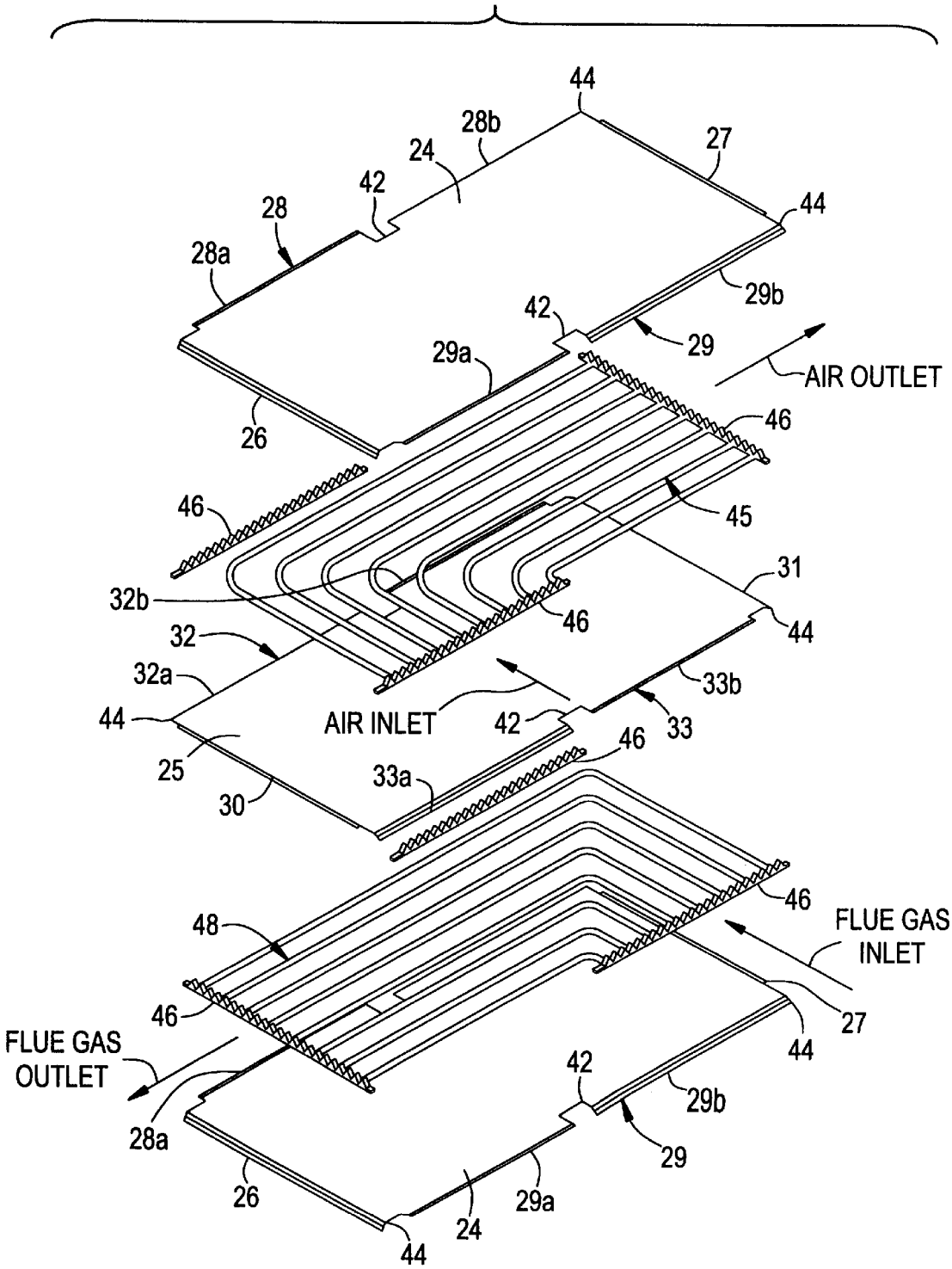
FIG. 2 is an exploded, isometric view of a plurality of heat exchanger plates and air and flue gas ribs for a portion of the heat exchanger block or unit in accordance with the present invention.
Figure 3:
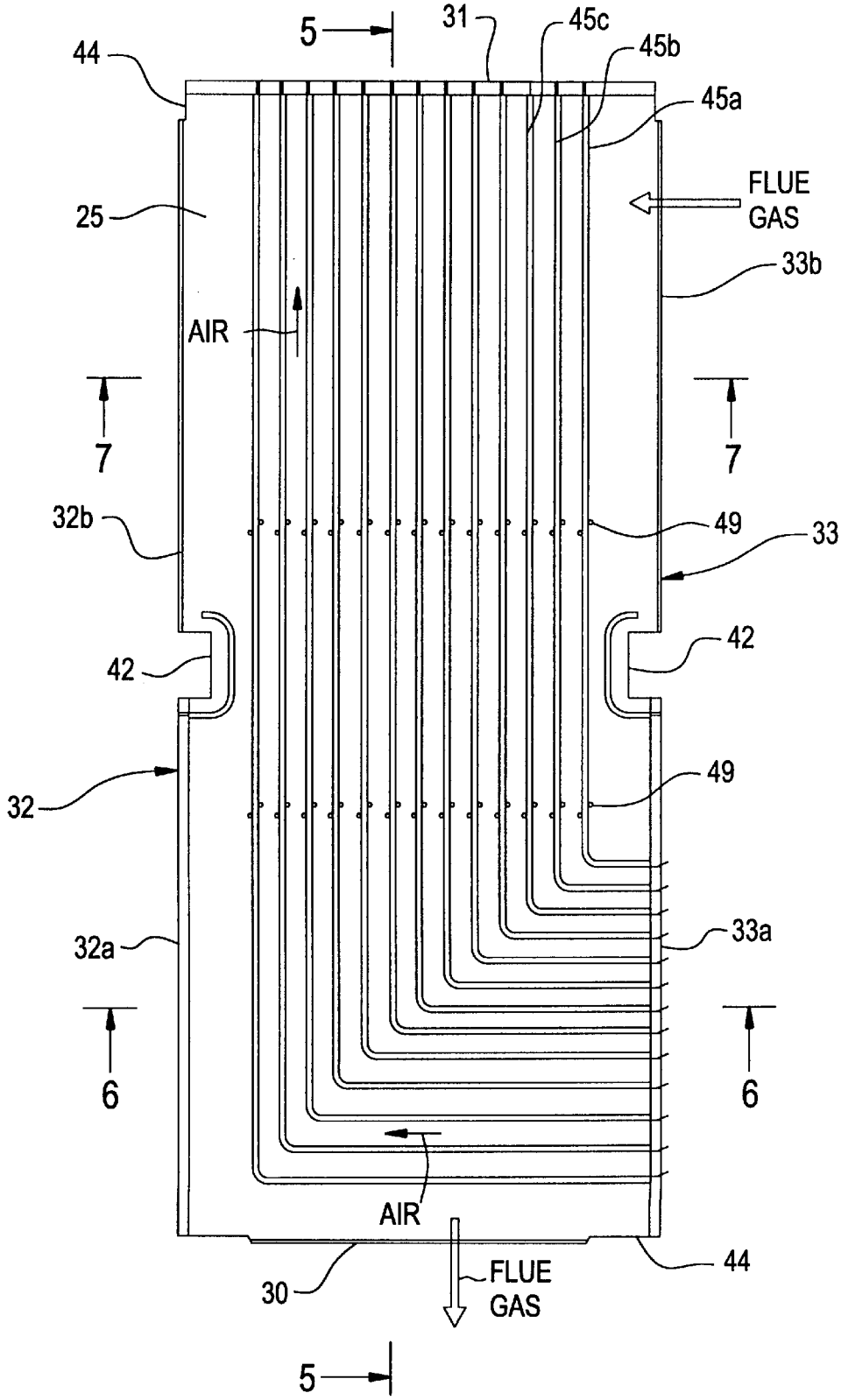
FIG. 3 is an elevational view of one of the heat exchanger plates and air flow ribs in the stack of FIG. 1, with the end cover and several plates removed.
Figure 4:
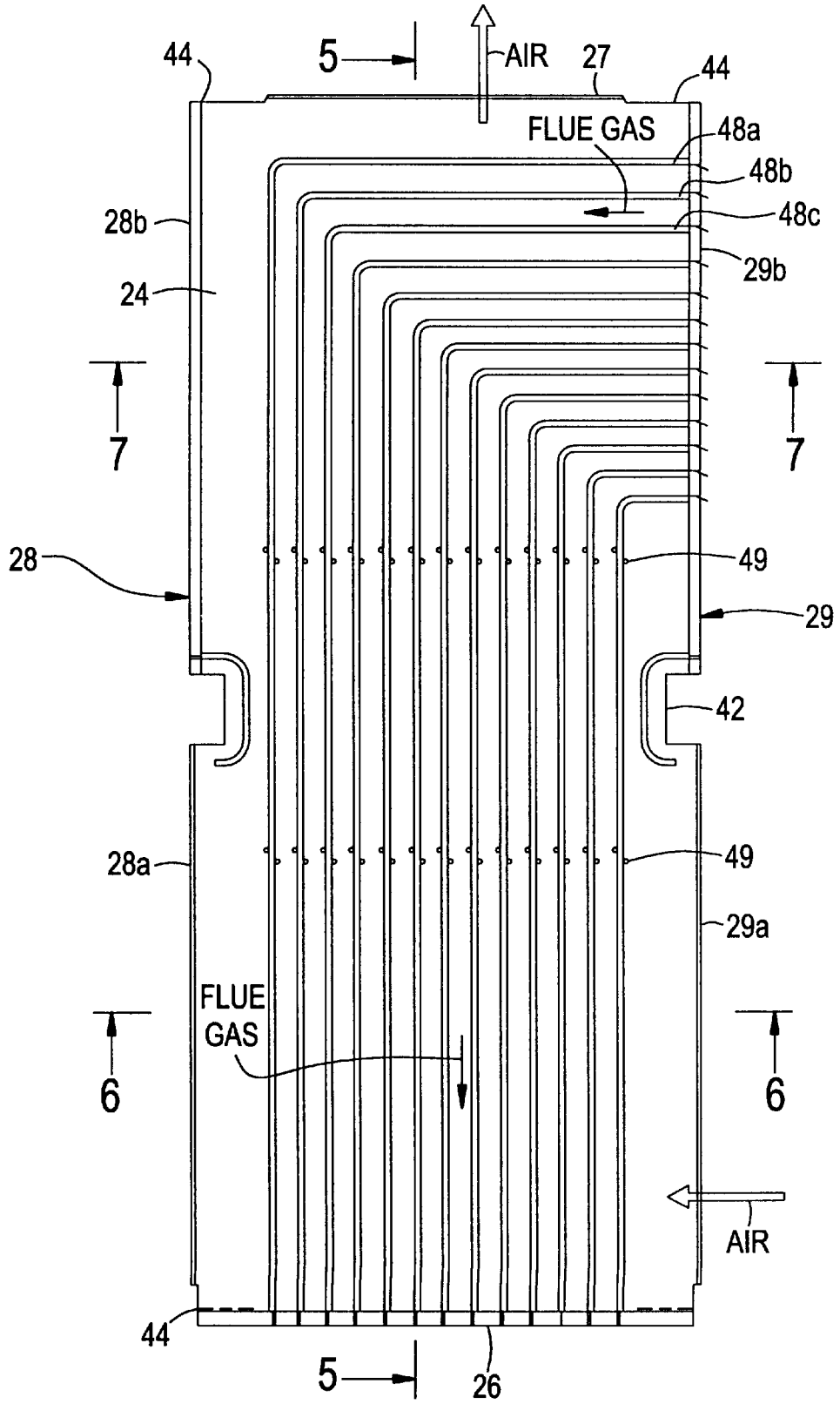
FIG. 4 is an elevational view, similar to that of FIG. 3, of a second heat exchanger plate and flue gas flow ribs.

Reference is next made to FIGS. 2, 3, and 4 which show various views of the heat exchanger plates and flow ribs used in the unit of FIG. 1. As shown best in FIG. 2, the stack of plates 11 comprise alternating air plates 24 and flue plates 25 which together define alternating air flow and flue gas flow chambers. Thus, the stack comprises a first set of heat exchanger plates in the form of the plates 24 and a second set of heat exchanger plates 25 interleaved between the first set. In the preferred embodiment, the air plates 24 are those plates which define the upper surface of an air flow chamber while the flue plates 25 are those plates which define the upper surface of a flue gas flow chamber.

Figure 5:
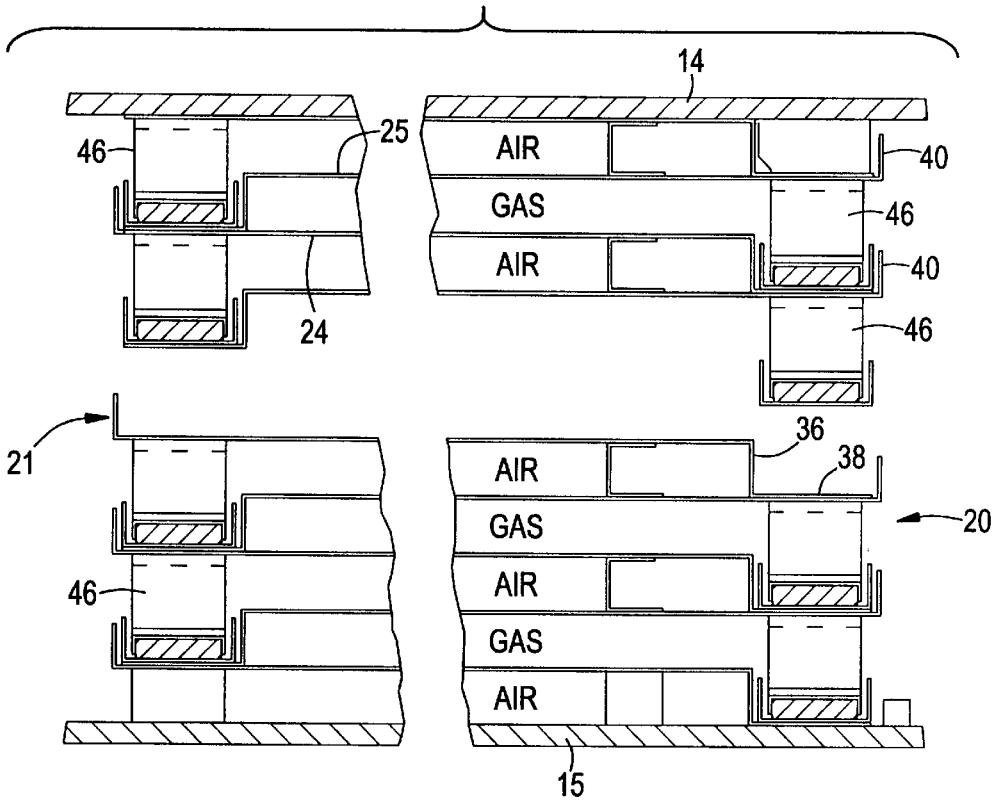
FIG. 5 is a sectional view of a heat exchanger unit of the present invention, with portions removed, as viewed along the section line 5—5 of FIGS. 3 and 4.
Figure 6:
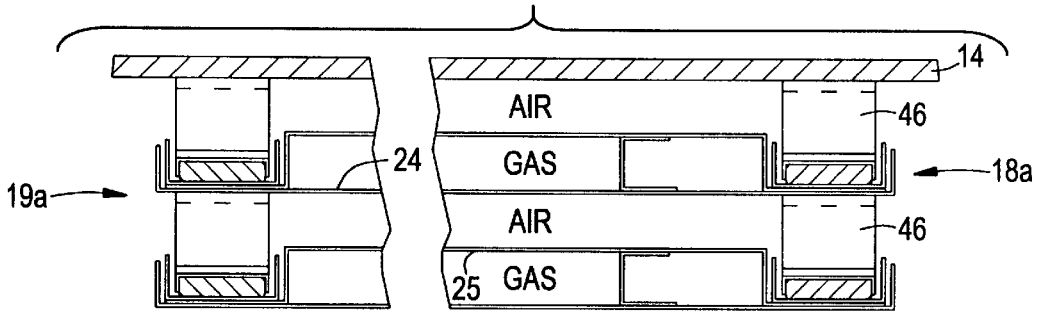
FIG. 6 is a sectional view, with portions removed and showing a representation flue gas flow rib, of a portion of a heat exchanger unit of the present invention as viewed along the section line 6—6 of FIGS. 3 and 4.
Figure 7:
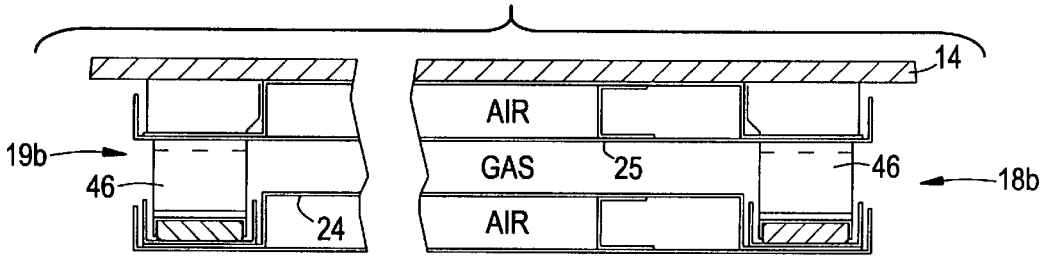
FIG. 7 is a sectional view, with portions removed and showing a representative air flow rib, of a portion of a heat exchanger unit of the present invention as viewed along the section line 7—7 of FIGS. 3 and 4.

Each of the air plates 24 has a generally rectangular configuration with a pair of generally planar first and second or top and bottom surfaces, a pair of first opposing, parallel edges 26 and 27 and a pair of second opposing, parallel edges 28 and 29 which are perpendicular to the first opposing edges 26 and 27. Each of the edges 28 and 29 comprise edge sections 28*a,* 28*b* and 29*a,* 29*b,* respectively. Each of the edges 26, 27, 28 and 29, or a portion thereof, terminates in either a first edge configuration in the form of an offset edge configuration 34 or a second edge configuration in the form of a turn-up or offset receiving edge configuration 35 as shown in FIG. 10. In FIG. 10, the offset edge configuration 34 comprises an offset leg section 36 perpendicular to the main plate surface 24/25 and a laterally extending leg section 38 at right angles to the leg 36. The turn-up or offset receiving edge configuration 35 includes a leg section 39 which is an integral extension of the main plate surface 24/25 and an up-turned leg section 40 positioned at the end of the leg 39 and at right angles thereto. As shown in FIGS. 5, 6 and 7, and as will be described in greater detail below, the combination of the offset edge 34 configuration and the offset receiving edge 35 configuration provide opposite surfaces for engagement with the spring assembly shown in FIGS. 8 and 9.

In the embodiment of FIG. 2, the edge 26 and the edge sections 28*b* and 29*b* are provided with offset edge configurations, while the edge 27 and the edge sections 28*a* and 29*a* are provided with offset receiving edge configurations. Each of the edges 28 and 29 includes a transition area 42 in the form of a recess positioned between the edge sections 28*a* and 28*b* and between the edge sections 29*a* and 29*b,* respectively. Each of the plates 24 is also provided with a corner 44 positioned at the intersections of the edges 26 and 27 with the edges 28 and 29. In the preferred embodiment, these corners 44 are notched.

Similarly, each of the flue plates 25 includes a pair of first opposing, parallel edges 30 and 31 and a pair of second opposing, parallel edges 32 and 33 which are perpendicular to the first opposing edges 30 and 31. Each of the edges 32 and 33 is likewise comprised of edge sections 32*a,* 32*b* and 33*a,* 33*b,* respectively. Further, similar to the plates 24, each edge and edge section of the flue plate 25 terminates in either an offset edge configuration 34 or an offset receiving edge configuration 35 as shown in FIG. 10. In the preferred embodiment, the edge 31 and the edge sections 32*a* and 33*a* are provided with offset edge configurations 34, while the edge 30 and the edge sections 32*b* and 33*b* are provided with offset receiving edge configurations 35. Also similar to the plates 24, each plate 25 is provided with a pair of transition areas 42 positioned between the edge sections 32*a* and 32*b* and between the edge sections 33*a* and 33*b*. Each plate 25 is also provided with a corner 44 at the intersections of the edges 30 and 31 with the edges 32 and 33.

In the preferred embodiment, the transition areas 42 are positioned mi-way between the edges 26 and 27 of the air plate 24 and midway between the edges 30 and 31 of the flue gas plate 25. Thus, in the preferred embodiment, both plates 24 and 25 are identical in structure; however, each plate 25 has an orientation relative to each plate 24 which is rotated 180° about an axis perpendicular to the surface of the plates.

When the plates 24 and 25 are assembled into the unit 10 of FIG. 1, the edges 26 and 30 correspond to the inlet/outlet face 20 and the edges 27 and 31 correspond to the inlet/outlet face 21. Similarly, the edge sections 29*a* and 33*a* correspond to the inlet/outlet face section 18*a,* the edge sections 28*a* and 32*a* correspond to the inlet/outlet face section 19*a,* the edge sections 29*b* and 33*b* correspond to the inlet/outlet face section 18*b* and the edge sections 28*b* and 32*b* correspond to the inlet/outlet face section 19*b*.

Positioned between the lower surface of each air plate 24 and the upper surface of each flue gas plate 25 as shown in FIG. 2 is an air flow rib assembly 45 and a plurality of spring assemblies 46. Similarly, positioned between the lower surface of each flue gas plate 25 and the upper surface of each air plate 24 is a flue gas flow rib assembly 48 and a plurality of spring assemblies 46.

As best shown in FIG. 3, the air flow rib assembly includes a plurality of ribs 45*a,* 45*b,* 45*c,* etc. which extend from the edge section 33*a* to the edge 31. Each of the air flow ribs 45*a–c,* etc. includes connection means at their ends for inter-connection with the spring assemblies 46 (FIG. 2) in a manner known in the art. Accordingly, in the preferred embodiment, the air enters the heat exchanger unit along the edge section 33*a* (corresponding to the inlet/outlet face section 18*a* of FIG. 1) and follows the path of the air flow ribs 45*a–c,* etc. and exits from the unit along the edge 31 (corresponding to the inlet/outlet face 21 of FIG. 1). The top surface of the plate 25 is provided with a plurality of dimples 49 for stabilizing and providing proper spacing for the ribs 45*a–c,* etc.

As best shown in FIG. 4, each flue gas flow rib assembly 48 includes a plurality of flue gas flow ribs 48*a,* 48*b,* 48*c,* etc. which extend from the edge section 29*b* of plate 24 to the edge 26. Similar to the rib assembly 46, the plurality of ribs 48*a–c,* etc. are provided with connection means at their ends for connecting the ribs to the spring assemblies 46 in a manner known in the art. A plurality of dimples 49 are also provided on the surface of the plates 24 to stabilize and provide proper spacing for the ribs 48*a–c,* etc. Accordingly, in the preferred embodiment, the flue gas enters the heat exchanger unit along the edge section 29*b* (corresponding to the inlet/outlet face section 18*b* of FIG. 1) and follows the path of the flue gas flow ribs 48*a–c,* etc. and exits from the unit along the edge 26 (corresponding to the inlet/outlet face 20 of FIG. 1).

Figure 8:
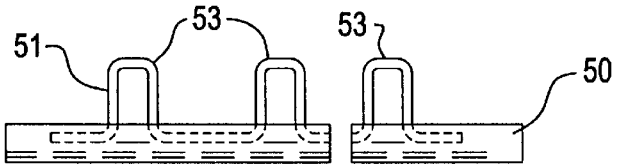
FIG. 8 is an elevational side view of the spring assembly.
Figure 9:
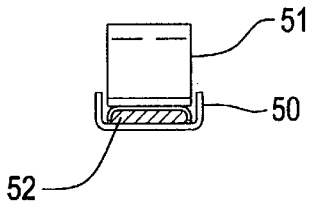
FIG. 9 is an elevational end view of the spring assembly.
Figure 10:
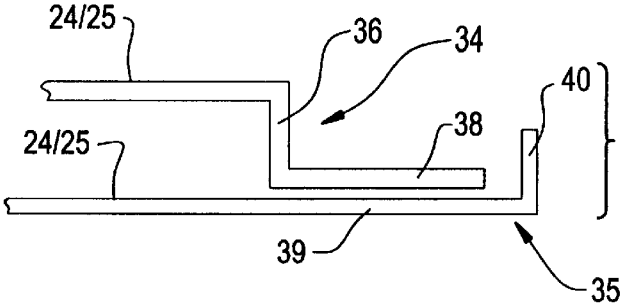
FIG. 10 is a sectional view through the ends of adjacent heat exchanger plates showing an offset edge configuration and a corresponding turn-up or offset receiving edge configuration.

The spring assemblies 46 have a structure known in the art and are shown best in FIGS. 8 and 9. Each spring assembly includes a generally U shaped base portion 50 constructed of metal or other rigid material, a compressible, resilient member 52 usually constructed of a synthetic material and a relatively rigid spacer element 51. As is known in the art, the rigid spacer element 51 forms loop sections 53 as shown in FIG. 8 which define open portions for passage of air or flue gas. These loop sections 53 also provide connection openings for connection of the flow ribs 45*a–c,* etc. and 48*a–c,* etc in a manner known in the art.

FIGS. 5, 6 and 7 comprise various cross-sectional configurations of a plurality of plates and associated structure as viewed along the section lines 5—5, 6—6 and 7—7 of FIGS. 3 and 4. As shown in FIG. 5, the air flow passages are open at the inlet/outlet face 21 but closed at the inlet/outlet face 20, while the flue gas flow passages are open to the inlet/outlet face 20 and closed at the inlet/outlet face 21. In FIG. 6 the air flow passages are open and the flue gas flow passages are closed at both the inlet/outlet face section 19*a* and the inlet/outlet face section 18*a*. In FIG. 7, the air flow passages are closed and the flue gas flow passages are open at both the inlet/outlet face section 19*b* and the inlet/outlet face section 18*b*.

FIGS. 11 and 12 disclose various corner post assemblies 12 positioned at each corner of the plurality of plates for stabilizing the plates and for sealing the plates at their corners to prevent or minimize leakage between the flue gas flow passages and the air flow passages. The corner assembly 12 of FIG. 11 is designed for use with a plurality of plates which are notched to create uniform interior square corners, while the corner post assembly 12 of FIG. 12 is designed for use with plates having a shallower notch along the offset receiving edge to create uniform exterior square corners. In the embodiment of FIG. 11, the corner post assembly 12 includes a plurality of rigid angle members 54, a pair of spring members in the form of a tubular configuration of spring metal or the like, a rigid angle member 56 and an angle shaped piece of compression material 57 engaging the edges of the plates. The angle members 54 are in turn retained by the top and bottom end plates 14 and 15 (FIG. 1) or by other portions of the housing in a manner known in the art. The spring members 55,55 exert a force against the rigid angle member 56 and thus the compression member 57, thereby forming a seal between adjacent plates. If desired, caulking (identified as the cross-hatched material) or other material can be introduced between the plates in the area of the corner to further seal any leaks that may occur. The corner post assembly of FIG. 11 can be used with any of the embodiments of FIGS. 2, 14 and 15, but must be used with the embodiment of FIG. 14.

The corner post assembly 12 of FIG. 12 is similar in that it includes a plurality of rigid angle members 58, a plurality of spring members 59 form of rolled up spring metal, a rigid angle member 60 and a compression member 61 engaging the edges of each of the plates. The angle members are connected with the end plates 14 and 15 or other portions of the frame or housing in a manner which causes a force to be exerted through the spring members 59 against the angle member 60 and thus the compression member 61, thereby sealing the chambers between adjacent plates from one another. The corner post assembly of FIG. 12 can be used with the embodiments of FIGS. 2 and 15, but is preferably not used with the embodiment of FIG. 14.

Reference is next made to FIG. 13 illustrating the mid-post assembly 22. The mid-post assembly is designed to stabilize the plates at the transition area 42 and to form a seal between adjacent chambers in the plates in this transition area. The mid-post assembly includes a plurality of rigid angle members 62, 63 and 64, a pair of elongated tubular spring members 65,65 a U shaped rigid member 66 and a U shaped compression member 68 adapted for engagement with the edges of the plates in the transition area. When assembled, the rigid angle members 62, 63, and 64 are connected with the end plates 14 and 15 (FIG. 1) or with other frame or housing portions of the unit. A force is exerted against the rigid member 66 by the spring members 65,65, thereby pressing the compression member 68 against the edges of the plates in the transition area. This seals the respective flow chambers and prevents leakage from one chamber to an adjacent chamber. To further seal this area, caulking 69 can be introduced between the plates in the transition area and adjacent to the compression member 68. Preferably, the caulking material 69 is retained by a caulk retaining rib 70 positioned between the plates and stabilized and connected at one end by the connection hook 71 to a portion of the spring assembly 46.

Figure 14:
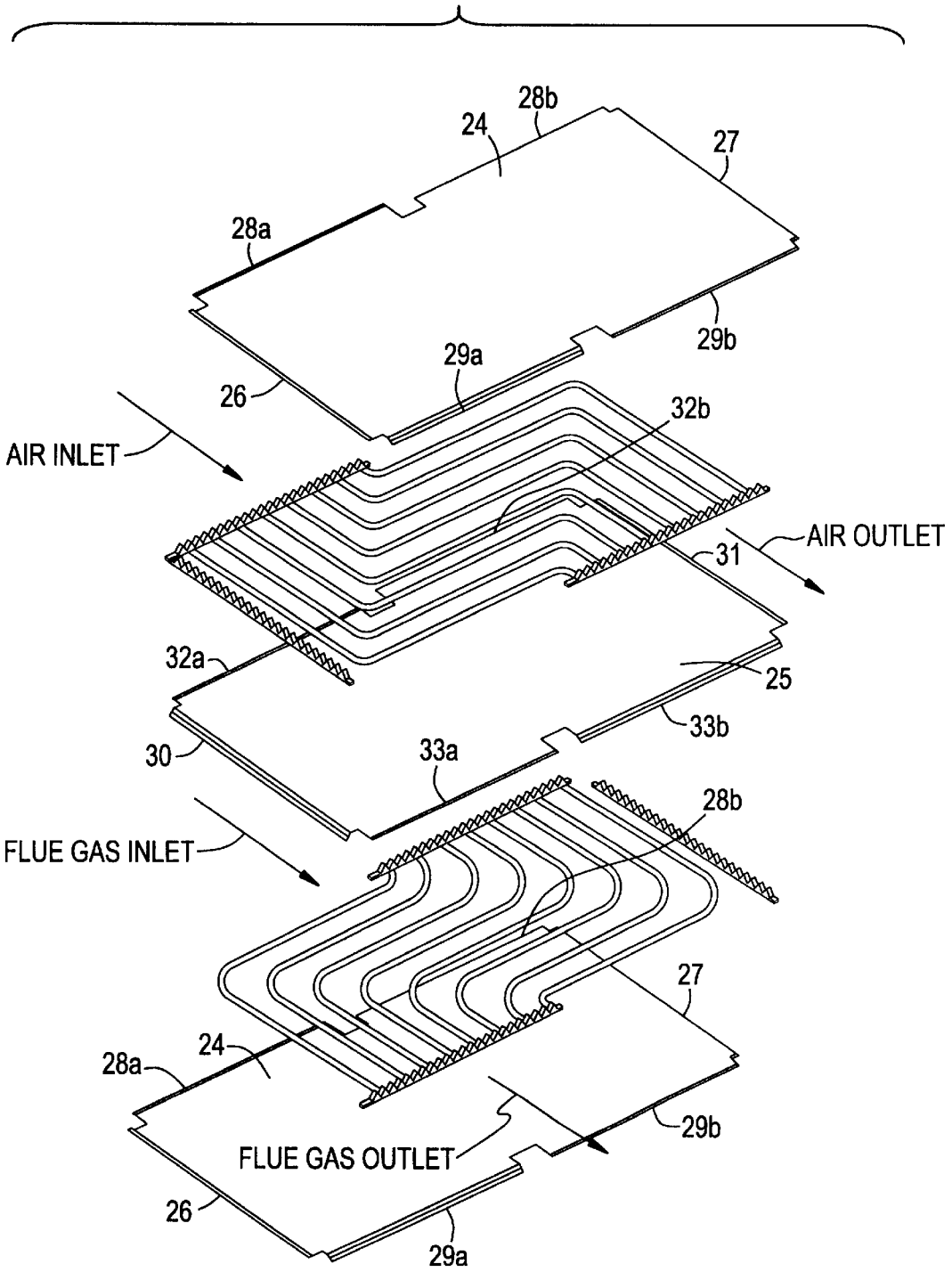
FIG. 14 is an isometric, exploded view, similar to that of FIG. 2, showing a further embodiment of a heat exchanger unit in accordance with the present invention.
Figure 15:
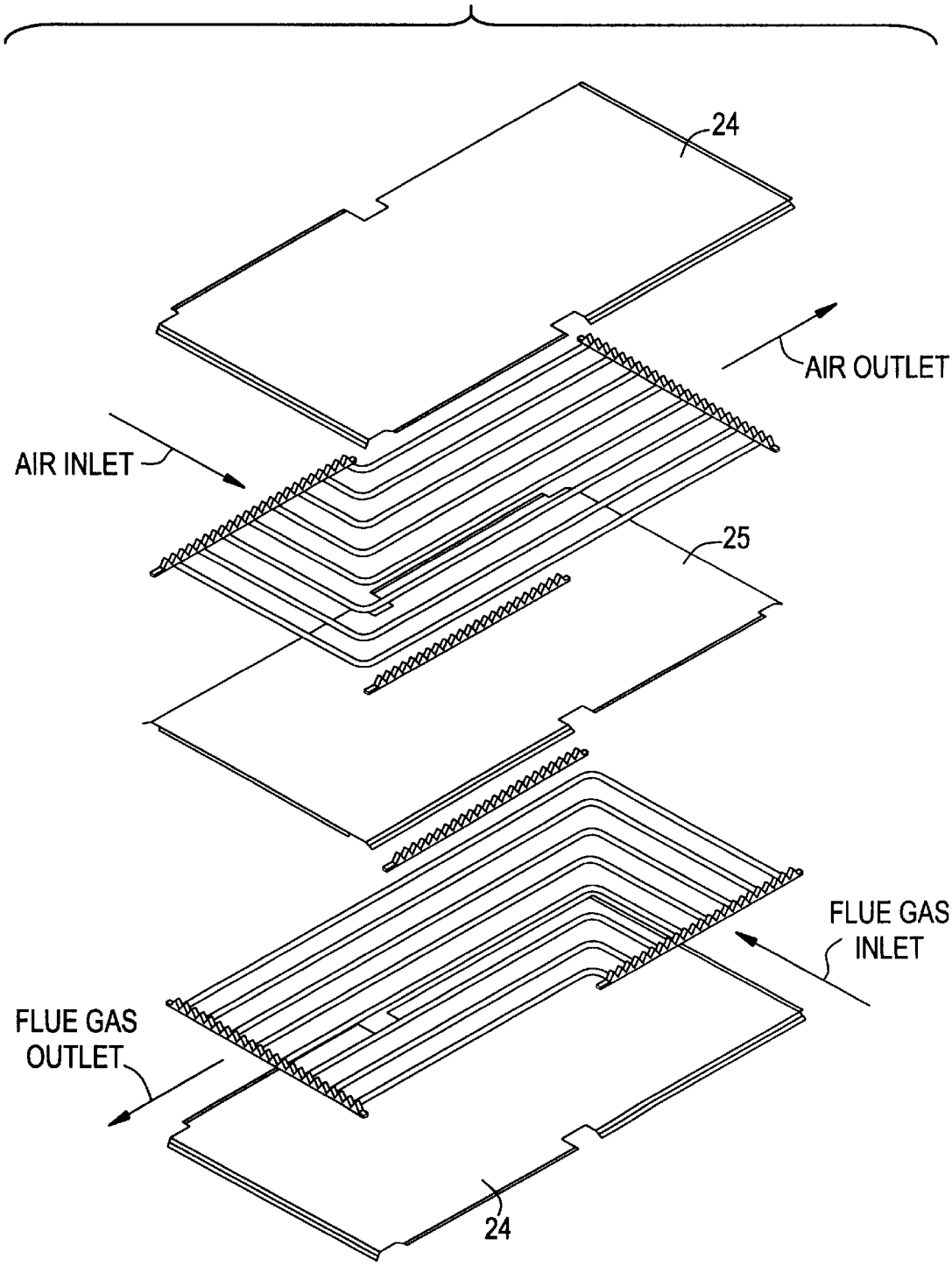
FIG. 15 is an isometric, exploded view, similar to that of FIGS. 2 and 14, showing a still further embodiment of a heat exchanger unit in accordance with the present invention.

FIGS. 14 and 15 are views similar to that of FIG. 2 except that they illustrate alternate embodiments of heat exchanger configurations in accordance with present invention. In the embodiment of FIG. 14, the air inlet and the flue gas inlet are along the same edge and the air outlet and the flue gas outlet are along the same edge. In this embodiment, the edge 27 and the edge sections 28*b* and 29*a* of the plate 24 are provided with offset edge configurations and the edge 26 and the edge sections 28*a* and 29*b* are provided with offset receiving edge configurations. The edge 30 and edge sections 32*a* and 33*b* of the plate 25 in this embodiment are provided with offset edge configurations, while the edge 31 and the edge sections 32*b* and 33*a* are provided with offset receiving edge configurations.

FIG. 15 shows a plate structure similar to the plate structure of FIG. 2, but with an air flow rib assembly 45 and a flue gas flow rib assembly 48 causing the air and flue gas to enter along opposing, parallel edges instead of along the same edge as in the embodiment of FIG. 2.

Accordingly, with the heat exchanger in accordance with the present invention, both air and flue gas can enter or exit on the same inlet/outlet face as shown in the embodiments of FIGS. 1–7 and FIG. 14 or on opposing but parallel inlet/outlet faces as shown in FIG. 15. The heat exchanger of the present invention also facilitates entry of the same fluid, whether it be air or flue gas, through a first inlet/outlet face and exit through a second inlet/outlet face which is at right angle to the entering face in a generally "L" shaped path as shown in FIGS. 1–7 and FIG. 15.

The structure which enables this air and flue gas passage includes a plurality of heat exchanger plates, with each plate being generally rectangular in configuration and having a pair of opposing, parallel first edges and a pair of opposing, parallel second edges which are perpendicular to the opposing first edges. At least one of these first and second edges includes first and second edge sections. Each of the opposing first and second edges terminates in either an offset edge configuration or an offset receiving edge configuration, with at least one of the opposing first and second edges (the one including first and second edge sections) having both an offset edge configuration section and an offset receiving edge configuration section. In the preferred embodiment, two opposing edges have first and second edge sections and thus both an offset edge configuration section and an offset receiving edge configuration section. Each of those opposing edges includes a transition area separating the offset edge configuration section from the offset receiving edge configuration section. When assembled, a mid-post assembly is provided in the transition area to stabilize and seal the plates at that point. Although not a necessity, it is preferable for the transition area to be equidistant between the ends of an edge to allow the same plate to be used both as an air plate and as a flue gas plate.

Although the description of the preferred embodiment has been quite specific, it is contemplated that various modifications could be made to the preferred and alternate embodiments without deviating from the spirit of the present invention. Accordingly, it is intended that the scope of the present invention be dictated by the appended claims rather than by the description of the preferred embodiment.

What is claimed is:

1. A plate-type heat exchanger for heat exchange between first and second fluid streams, said heat exchanger comprising:

a stack of generally rectangular heat exchanger plates comprised of a first set of said heat exchanger plates and a second set of said heat exchanger plates interleaved between said first set so that said stack is comprised of alternating heat exchanger plates from said first and second sets, each of said plates having a first fluid surface and an opposite second fluid surface and positioned in spaced, generally parallel relationship to one another so that the first fluid surface of plates in said first set faces the first fluid surface of plates in said second set and the second fluid surface of plates in said first set faces the second fluid surface of plates in said second set, each of said plates further having a pair of generally parallel first edges and a pair of generally parallel second edges, said second edges being generally perpendicular to said first edges, at least one of said first and second edges having first and second edge sections, each of said first and second edges and each of said first and second edge sections terminating in either a first edge configuration or a second edge configuration with said first edge section terminating in one of said first and second edge configurations and said second edge section terminating in the other of said first and second edge configurations, and further with each of said first and second edges and said first and second edge sections of said first set of plates terminating in one of said first and second edge configurations and each of the corresponding first and second edges and first and second edge sections of said second set of plates terminating in the other of said first and second edge configurations, said stack being mounted within a frame comprising first and second end frame members, a plurality of corner posts extending between said first and second end frame members and a mid-post extending between said first and second end frame members and positioned between two adjacent corner posts;

a first set of fluid flow directing members positioned between the first fluid surface of each heat exchanger plate in said first set and the first fluid surface of an adjacent heat exchanger plate in said second set; and a second set of fluid flow directing members positioned between the second fluid surface of each heat exchanger plate in said first set and the second fluid surface of an adjacent heat exchanger plate in said second set.

2. The heat exchanger of claim 1 wherein said mid-post separates said first and second edge sections.

3. The heat exchanger of claim 1 wherein one of said first edges includes first and second edge sections with said first edge section of said one first edge being adjacent to one of said second edges and said second edge section of said one first edge being adjacent to the other of said second edges.

4. The heat exchanger of claim 3 wherein said first set of flow directing members extends from said first edge section of said one first edge to said other of said second edges.

5. The heat exchanger of claim 4 wherein said second set of flow directing members extends from said second edge section of said one first edge to said one of said second edges.

6. The heat exchanger of claim 3 wherein the other of said first edges includes first and second edge sections with said first edge section of said other first edge being adjacent to said one of said second edges and said second edge section of said other first edge being adjacent to said other of said second edges.

7. The heat exchanger of claim 6 wherein said first set of flow directing members extends from said first edge section of said one first edge to said second edge section of said other first edge.

8. The heat exchanger of claim 7 wherein said second set of flow directing members extends from said second edge section of said one first edge to said first edge section of said other first edge.

9. The heat exchanger of claim 6 wherein said first set of flow directing members extends from said first edge section of said one first edge to said other of said second edges and wherein said second set of flow directing members extends from said second edge section of said other first edge to said one of said second edges.

10. The heat exchanger of claim 1 wherein one of said first and second edge configurations is an offset configuration and the other of said first and second edge configurations is an offset receiving configuration.

11. The heat exchanger of claim 10 including spring assemblies positioned between adjacent plates along said first and second edges.

12. A heat exchanger plate for a plate-type heat exchanger for heat exchange between first and second fluid streams, said plate comprising:

first and second generally rectangular planar surfaces on opposite sides of said plate;

a pair of generally parallel first edges;

a pair of generally parallel second edges, said second edges being generally perpendicular to said first edges and at least one of said first and second edges having first and second edge sections;

a mid-post notch separating said first and second edge sections;

each of said first and second edges and each of said first and second edge sections terminating in either a first edge configuration or a second edge configuration with said first edge section terminating in one of said first and second configurations and said second edge section terminating in the other of said first and second edge configurations.

13. The heat exchanger plate of claim 12 wherein one of said first edges includes first and second edge sections.

14. The heat exchanger plate of claim 13 wherein the other of said first edges includes first and second edge sections.

15. The heat exchanger of claim 14 wherein said first edge section of said one first edge and said first edge section of said other first edge are adjacent to one of said second edges and said second edge section of said one first edge and said second edge section of said other first edge are adjacent to the other of said second edges.

16. The heat exchanger of claim 15 wherein said second edge section of said one first edge and said first edge section of said other first edge terminate in said first edge configuration and wherein said second edge section of said other first edge and said first edge section of said one first edge terminate in said second edge configuration.

17. The heat exchanger of claim 16 wherein said one second edge terminates in said first edge configuration and said other second edge terminates in said second edge configuration.

* * * * *